United States Patent [19]

Terai et al.

[11] 3,935,084

[45] Jan. 27, 1976

[54] ANODIZING PROCESS

[75] Inventors: Shiro Terai, Nagoya; Akinari Ichiryu, Aichi; Toshio Suzuki, Kasugai; Yoshikatsu Hayashi, Nagoya, all of Japan

[73] Assignee: Sumitomo Light Metal Industries, Ltd., Tokyo, Japan

[22] Filed: Mar. 28, 1974

[21] Appl. No.: 455,947

[52] U.S. Cl. ..... 204/58; C25D/11/08

[51] Int. Cl.[2] ..... C25D 11/14

[58] Field of Search ..... 204/58, 35 N

[56] References Cited

UNITED STATES PATENTS 3,759,801 9/1973 Patrie et al. ..... 204/58

3,773,631 11/1973 Immel et al. ..... 204/58

*Primary Examiner*—R. L. Andrews

*Attorney, Agent, or Firm*—Larson, Taylor and Hinds

[57] ABSTRACT

A colored oxide film on the surface of aluminium or an alloy thereof can be formed by anodizing at a D.C. voltage in an electrolyte based on sulfuric acid, followed by alternating current electrolysis at an A.C. voltage which is lower than the D.C. voltage.

In order to increase the degree of coloring of the colored oxide film, after the alternating current electrolysis the A.C. voltage is raised to a higher level but lower than the D.C. voltage, followed by dropping the voltage down to a level of the A.C. voltage or thereabout.

5 Claims, 1 Drawing Figure

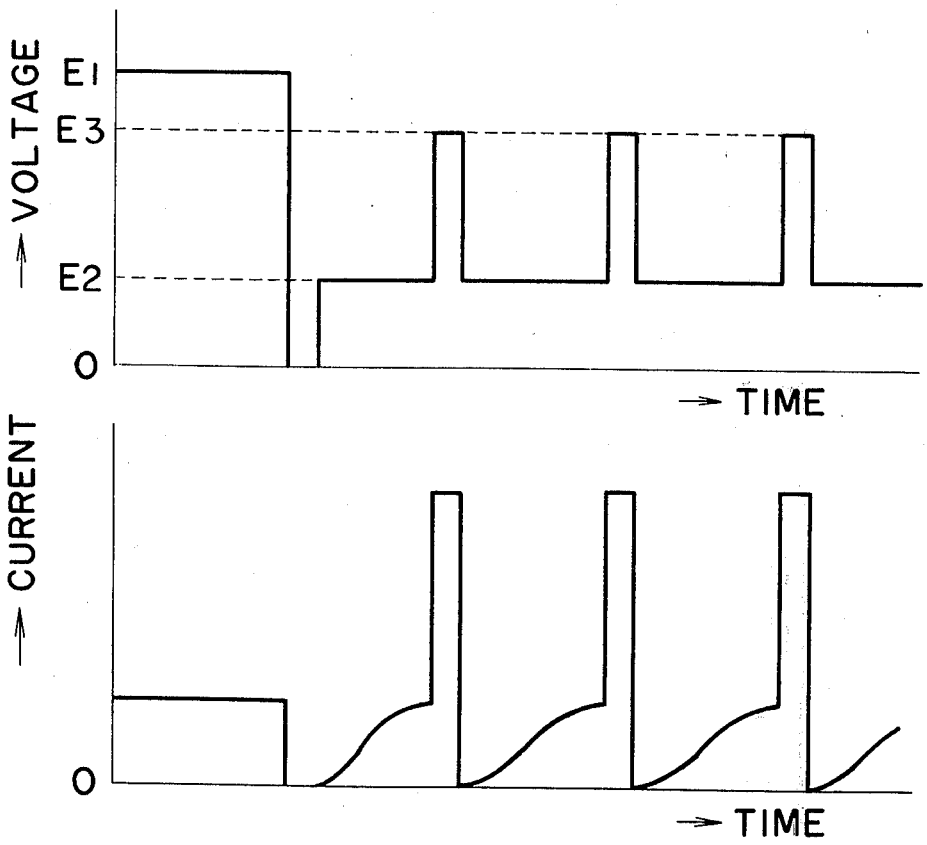
VOLTAGE
E1
E3
E2
0
TIME
CURRENT
0
TIME

ANODIZING PROCESS

The present invention relates to an anodizing process for aluminium or an aluminium base alloy and more particularly to a method of forming a colored oxide film on the surface of aluminium or an aluminium base alloy by the combination of direct current anodizing and alternating current electrolysis.

The known methods which have been used to form a colored oxide film on an aluminium substrate include the following:

a. Anodizing of aluminium in an electrolyte of an organic sulfonic acid;

b. Anodizing of aluminium in an aqueous sulfuric acid solution followed by the immersion of the anodized aluminium in a solution containing an inorganic metal salt;

c. Anodizing of aluminium in an aqueous sulfuric acid solution, followed by subjecting the anodized aluminium to alternating current electroylsis in a solution containing a heavy metal salt.

These methods, however, have some disadvantages as mentioned below:

Method (a) which is described, for example, in Japanese Pat. Specfication No. 296079, is carried out in an electrolyte which is much more expensive than sulfuric acid and under electrolysis conditions of a high voltage and current density. Thus, its installation is costly. Method (b) includes one in which anodized aluminium is immersed in a solution of ferric ammonium oxalate to develop golden color and one described in Japanese Pat. Publication No. 9805/69. Such immersion methods are difficult to achieve uniform coloring and not easy to control pH in an immersion bath. Method (c) which is described, as a typical example, in Japanese Patent Specification No. 310,401, imports excellent light resistance and a wide range of color tones to the film and so broadly used. However, this method also has some drawbacks that it is difficult to control the coloring bath, the use of two electrolysis bathes renderes the process complicated and the presence of heavy metal ions causes the problem of pollution.

An object of the present invention is to provide a process of forming a colored oxide film in an anodizing manner which can overcome the abovementioned drowbacks of the prior art methods.

According to an aspect of the present invention, therefore, there is provided a process of forming a colored oxide film on the surface of aluminium or an aluminium base alloy, which comprises subjecting it to anodizing at a direct-current voltage $E_1$ in an electrolyte based on sulfuric acid to give a substantially colorless oxide film of a required thickness and then subjecting the anodized aluminium or alloy to alternating current electrolysis at a voltage $E_2$ which is lower than the voltage $E_1$.

In the process of the invention, the direct current anodizing is carried out in an electrolyte based on sulfuric acid, for example, in an aqueous solution of 10 to 15% by weight of sulfuric acid and under normal anodizing conditions, for example, at a current density of 1 $A/dm^2$ for a period of 40 minutes. The voltage $E_1$ to be impressed is generally 10 to 20 volts. After a substantially colorless transparent oxide film has been formed on the surface of aluminium or an alloy thereof to a required thickness, the impressed voltage is dropped down to zero with interruption of the direct current.

Then, a voltage $E_2$ which is lower than the voltage $E_1$ is applied through an alternating current or a highly pulsating current source to carry out the alternating current electrolysis. With the impressed voltage $E_2$ of a level lower than that of $E_1$, no electric current flows immediately but it begins to flow gradually after the lapse of several seconds or minutes and reaches a stationary current after a while. This phenomenon is commonly designated as "recovery effect" and the time after an electric current begins to flow and before it reaches a stationary current is denoted as "recovery time".

The present invention is based on the discovery that said recovery effect plays a part in coloring of the anodized oxide film and thus a colored film of a variety of color tones may be formed by appropriately selecting the anodizing and/or alternating current electrolysis conditions such as impressed voltage, composition of electrolyte and temperature and time of electrolysis.

A colored oxide film can be obtained by displaying the recovery effect only once, in which case, however, the degree of coloring is often lower. It is therefore advisable to display the recovery effect repeatedly so as to obtain an oxide film of a higher degree of coloring. For this purpose, it is essential to raise the voltage $E_2$ to a level of $E_3$ over a short time after continuing to impress the voltage $E_2$ for a given period of time but before reaching the stationary current, the level of $E_3$ being higher than that of $E_2$ but lower than that of $E_1$, and then to suddenly drop the voltage $E_3$ again down to the level of $E_2$ or thereabout. Two or more repetitions of the operation of the rise and drop in voltage may vary the color tone of the film by degrees.

Each of the voltages $E_2$ and $E_3$ to be applied in the repeat operations may vary somewhat, for example, within a limit up to 1 volt.

An electrolyte for use in the present process is one based on sulfuric acid and is usually an aqueous solution of 4 to 15% by weight of sulfuric acid. It has been found that color tone of the film may be more or less shifted by adding to the electrolyte a small amount of an ammonium salt or a metal salt including salts of Ni, Co, Cu, Nm, Zn, Cr, Sn and V with sulfuric, hydrochloric, nitric, phosphoric, chromic or oxalic acid.

Further, it has been found possible to give an oxide film of a more opaque color tone by adding to the electrolyte an acid including boric acid, organic dicarboxylic acids such as oxalic, malonic, maleic or tartaric acid and organic sulfonic acids such as p-phenol sulfonic or sulfosalicylic acid.

The amount of these salts or acids to be added may be generally in the range 0.1 to 10% by weight of the electrolyte used. These salts or acids may also act as stabilizers for the electrolyte.

The present invention is further illustrated with reference to the accompanying drawing, in which the figure includes two graphs each showing the variation of the voltage and electric current applied with lapse of time in the D.C. anodizing and the A.C. electrolysis according to an embodiment of the invention.

Firstly, the anodizing is carried out at a direct-current voltage $E_1$ in a conventional manner to form an oxide film of a required thickness (e.g. 10 microns) on the surface of aluminium or an alloy thereof.

After interrupting the passage of the electric current, an alternating-current or a highly pulsating-current voltage $E_2$ is impressed which is lower than the voltage $E_1$. The impressed voltage $E_2$ (mean value) is generally 1 to 5 volts, preferably 2 to 4 volts. The lower the voltage, the longer the recovery time, which results in the formation of the opaquer film of greyish black color. On the other hand, with a higher level of the voltage $E_2$ the film formed looks nearly transparent and pale bronze, crimson or green in color. If a voltage exceeding 4 volts is applied, the recovery time will fall within one minute, when it will be difficult to obtain a colored oxide film.

The time during which the voltage $E_2$ is applied may vary depending on the electrolysis conditions and the desired color tones, although it is generally 2 to 20 minutes.

The D.C. anodizing at the voltage $E_1$ and the subsequent A.C. electrolysis at the voltage $E_2$ may be carried out in the same electrolyte of an aqueous sulfuric acid solution or alternatively in different electrolytes, for example, by adding a metal salt or an acid as set out above to an electrolyte to be used in either treatment.

With an aqueous sulfuric acid solution as electrolyte, its concentration of lower than 4% by weight tends to cause pitting during the first anodizing while the concentration of higher than 15% by weight gives a too short of a recovery time leading to unsatisfactory coloring.

The temperature of the electrolyte is preferably in the range of 20° to 40°C. In general, the lower the temperature, the longer the recovery time which results in the formation of the film of greyish black color. At a temperature exceeding 40°C considerable dissolution by sulfuric acid will take place and hence it will be difficult to form a desirable colored film.

As a result of the recovery effect from the application of the voltage $E_2$ there may be formed a colored oxide film. Where it is intended to increase the degree of coloring of the film, it is required to raise the voltage $E_2$ to a level of $E_3$, for example, on the order of 10 volts, which is lower than that of $E_1$ before the electric current reaches the stationary state, for instance, when the current density has amounted to 0.3 to 1.3 A/dm². After applying the voltage $E_3$ for 1 to 5 seconds, it is suddenly dropped down to the level of $E_2$ or thereabout to again display the recovery effect. If necessary or desired, the operation of the rise and drop in voltage can be further repeated.

As seen from the graph of electric current-time, the electric current is reduced to zero on the sudden drop of the voltage from $E_3$ to $E_2$.

The process of the invention can be applied to any anodizable aluminium and aluminium base alloy and has the following advantages:

1. It is sufficient to use an aqueous sulfuric acid solution alone as electrolyte, which leads to no pollution concerns, low cost for carrying the process into practice and good stability of the electrolyte.
2. The desired object can be attained using D.C. and A.C. sources, resulting in inexpensive installations.
3. Since the overall processes may be effected in the same bath, the course of the processes is short and the control thereof is easy.
4. There may be formed films of a wide range of color tones regardless of the nature of the material to be anodized.

The following examples further illustrate, but in no way limit the present invention.

EXAMPLE 1

Using as an anode an extruded form (50×100×1 mm) of aluminium alloy composed of Al, Mg and Si in weight proportions of 1:0 6:0.45 and as cathode a carbon plate, the anodizing through a direct current source was carried out at a current density of 1 A/dm² in an aqueous solution of 5% by weight of sulfuric acid at 25°C for 10 minutes. Thus, a substantially colorless transparent oxide film of 2.5 microns thick was formed on the surface of the aluminium alloy.

Then, the anodized aluminium alloy was subjected to the alternating current electrolysis at a voltage of 2.5 volts in the same electrolyte. At first no electric current was found to flow but it began to flow gradually with lapse of time. It was observed that the color of the film was shifting to grey with evolution of gases from the surface of the aluminium alloy. Ten minutes later the electric current ceased to pass when the current density amounted to 0.3 A/dm².

The film thus formed had a grey color and a thickness of 2.5 microns unchanged.

EXAMPLE 2

Using the same extruded form of aluminium alloy as in Example 1, the D.C. anodizing was carried out at a current density of 1 A/dm² in an aqueous solution of 10% by weight of sulfuric acid at 35°C for 10 minutes. Then, through an A.C. source a voltage of 3.0 volts was applied. Seven minutes later the electric current ceased to pass when the current density was 0.7 A/dm². The film thus formed was bronze in color.

EXAMPLE 3

The D.C. anodizing was effected in the same manner as in Example 1, except that the anodizing time was 40 minutes, to form an oxide film of 10 microns thick.

Then, the anodized aluminium was subjected to the A.C. electrolysis at a voltage of 2.5 volts. 15 Minutes later, when the current density amounted to 1.0 A/dm², the voltage was raised to 10 volts over 30 seconds. After a few seconds the voltage was suddenly dropped down again to 2.5 volts. Then, the electric current was interrupted but began to flow after a while. About 5 minutes after the voltage was retained at 2.5 volts, the current density amounted to 1 A/dm², when the electric current was ceased to pass.

The film so formed had a color slightly deeper grey than that of the film obtained in Example 1.

EXAMPLE 4

Following the procedure as described in Example 3 except that the operation of the rise and drop in voltage was repeated four times (that is, the recovery effect was repeatedly displayed four times), the film formed was deep greyish black in color.

EXAMPLE 5

Following the procedure as in Example 3 except that the material to be anodized was replaced by pure aluminium, the film obtained had a grey color and appeared slightly transparent.

EXAMPLE 6

By a similar procedure to that of Example 3, the anodizing through a D.C. source was carried out in an aqueous solution of 7% by weight of sulfuric acid at 350°C for 30 minutes.

Then, a voltage of 2.5 volts was applied through an A.C. source, three minutes after which the voltage was raised to 8 volts and then suddenly dropped down to 2.5 volts. Three repetitions of the operation of the rise and drop in voltage gave the film of a bronze color.

EXAMPLE 7

Following the procedure as described in Example 6 except that the concentration of an aqueous sulfuric acid solution was 10% by weight, the film formed had a redish violet color.

EXAMPLE 8

The same procedure as in Example 6 was repeated but the electrolyte employed was an aqueous solution of 10% by weight of sulfuric acid to which 0.5% by weight of zinc sulfate had been added. The film thus formed had a green color.

EXAMPLE 9

The D.C. anodizing was carried out for 40 minutes under similar conditions to those of Example 1, with a variant that there was used as electrolyte an aqueous solution of 10% by weight of sulfuric acid to which 1.0% by weight of p-phenol sulfonic acid had been added.

Then, the anodized aluminium was subjected to the A.C. electrolysis at a voltage of 2.5 volts, ten minutes after which the voltage was raised to 10 volts. Thereafter, the voltage was suddenly dropped down to 2.5 volts and the electric current was ceased to pass when the current density amounted to 1 A/dm$^2$.

The film so formed was deep grey in color.

EXAMPLE 10

Following the procedure as in Example 1 except that 1% by weight of ammonium molybdate was added to the aqueous sulfuric acid solution, the film formed was slightly redish grey in color.

EXAMPLE 11

Using as an anode a plate of pure aluminium 1100-H24 (JIS Standard) and as a cathode a carbon plate, the anodizing through a D.C. current was carried out at a current density of 1 A/dm$^2$ in an aqueous solution of 14% by weight of sulfuric acid and 1% by weight of copper sulfate at a temperature of 25°C for 10 minutes. The oxide film formed was 2.5 microns thick.

Then, the anodized aluminium was subjected to the A.C. electrolysis at a voltage of 2.5 volts in the same electrolyte, about eight minutes after which the voltage was raised to 10 volts and then dropped suddenly down to 2.5 volts. Three repetitions of the operation of the rise and drop in voltage yielded the film of a redish bronze color.

What we claim is:

1. A process of forming a colored oxide film on a substrate of aluminium or an aluminium alloy, which comprises subjecting the substrate to anodizing at a direct-current voltage $E_1$ of 10 to 20 volts in an electrolyte comprising an aqueous solution of 4 to 15% by weight of sulfuric acid to form a substantially colorless oxide film on the surface of the substrate, then dropping the voltage $E_1$ to zero and subjecting the substrate carrying the oxide film on its surface to electrolytic treatment in the same electrolyte by applying an alternating-current voltage $E_2$ of 2 to 4 volts for a period of 2 to 20 minutes to develop a recovery effect and obtain an oxide film of desired color tone.

2. A process as claimed in claim 1, which further comprises raising the voltage $E_2$ to a higher voltage $E_3$ in the range 5 to 10 volts and suddenly dropping the voltage $E_3$ after applying it for a period of seconds down to a voltage within the range of $E_2$.

3. A process as claimed in claim 2, which further comprises repeating the voltage cycle of the rise and the drop once or more times.

4. A process as claimed in claim 1, in which there is present in the electrolyte an acid selected from boric, oxalic, malonic, maleic, tartaric, p-phenol sulfonic and sulfosalicylic acids in an amount of 0.1 to 10% by weight of the electrolyte.

5. A process as claimed in claim 1, in which the electrolyte is maintained at a temperature of 20° to 40°C while the voltage $E_2$ is being applied.

* * * * *